US005197195A

United States Patent [19]

Aikens

[11] Patent Number: 5,197,195

[45] Date of Patent: Mar. 30, 1993

[54] CUTTING GUIDE APPARATUS

[76] Inventor: John S. Aikens, 2633 W. Regal Ct., Lawrenceville, Ga. 30244

[21] Appl. No.: 840,042

[22] Filed: Feb. 24, 1992

[51] Int. Cl.[5] ..... B26B 29/00; B26B 11/00; B43L 13/02

[52] U.S. Cl. ..... 30/293; 33/42; 7/163

[58] Field of Search ..... 30/293, 289, 286, 282, 30/269, 263; 7/119, 164, 163; 33/42, 43, 44, 41.4

[56] References Cited

U.S. PATENT DOCUMENTS

| | | | |
|---|---|---|---|
| 2,335,513 | 11/1943 | Hewitt | 33/42 |
| 2,681,507 | 6/1954 | Underwood | 33/42 |
| 3,286,351 | 11/1966 | McAlister | 33/42 |
| 4,414,745 | 11/1983 | Kuhlmann | 33/42 |
| 4,512,081 | 4/1985 | Park | 33/42 |
| 4,520,571 | 6/1985 | Harding | 33/42 |
| 4,794,692 | 1/1989 | Wang | 7/163 |
| 4,799,315 | 1/1989 | Ziegler | 30/293 |
| 4,866,847 | 9/1989 | Batrack et al. | 30/293 |
| 5,083,375 | 1/1992 | Helm, Sr. | 33/42 |

*Primary Examiner*—Douglas D. Watts
*Assistant Examiner*—Paul M. Heyrana, Sr.
*Attorney, Agent, or Firm*—Leon Gilden

[57] ABSTRACT

An elongate handle includes a magazine housing secured adjacent a forward distal end of the handle, with the magazine housing positioned in contiguous communication to a rear surface of a guide plate. The magazine includes a reel of a flexible measuring tape extending from the magazine orthogonally through the guide plate and secured relative to the guide plate by a collet member to permit selective extension of the measuring web relative to the magazine and handle. A forward distal end of the guide web includes a support beam including a mount for a writing instrument and a cutting tool thereto.

5 Claims, 4 Drawing Sheets

CUTTING GUIDE APPARATUS

BACKGROUND OF THE INVENTION

1. Field of the Invention

The field of invention relates to cutting apparatus, and more particularly pertains to a new and improved cutting guide apparatus wherein the same is arranged for the selective scribing and cutting for indication along a workpiece to be subsequently severed completely.

2. Description of the Prior Art

In the carpentry field and the like, the measurement along a sheet-like material to include plaster board, plywood, glass, and the like is typically effected by tools of elaborate construction. The instant invention attempts to overcome deficiencies of the prior art by providing for an apparatus permitting ease of measurement along a workpiece board member.

Prior art available in a cutting guide procedure is exemplified in the U.S. Pat. No. 3,509,633 to Fernandes setting forth a cutting guide arranged for mounting along a corner portion of a workpiece to permit cutting of a workpiece paper at a corner portion thereof.

U.S. Pat. No. 3,862,494 to Andersson sets forth a hand tool for the cutting of wallpaper, carpets, and the like relative a wall surface.

U.S. Pat. No. 4,852,259 to Manserra sets forth a straight edge cutter guide.

As such, it may be appreciated that there continues to be a need for a new and improved cutting guide apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of cutting guide apparatus now present in the prior art, the present invention provides a cutting guide apparatus wherein the same is arranged to direct a marking and/or cutting tool relative to an edge portion of a planar workpiece sheet member. As such, the general purpose of the present invention, which will be described subsequently in greater detail, is to provide a new and improved cutting guide apparatus which has all the advantages of the prior art cutting guide apparatus and none of the disadvantages.

To attain this, the present invention provides an elongate handle including a magazine housing secured adjacent a forward distal end of the handle, with the magazine housing positioned in contiguous communication to a rear surface of a guide plate. The magazine includes a reel of a flexible measuring tape extending from the magazine orthogonally through the guide plate and secured relative to the guide plate by a collet member to permit selective extension of the measuring web relative to the magazine and handle. A forward distal end of the guide web includes a support beam including a mount for a writing instrument and a cutting tool thereto.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cutting guide apparatus which has all the advantages of the prior art cutting guide apparatus and none of the disadvantages.

It is another object of the present invention to provide a new and improved cutting guide apparatus which may be easily and efficiently manufactured and marketed.

It is a further object of the present invention to provide a new and improved cutting guide apparatus which is of a durable and reliable construction.

An even further object of the present invention is to provide a new and improved cutting guide apparatus which is susceptible of a low cost of manufacture with regard to both materials and labor, and which accordingly is then susceptible of low prices of sale to the consuming public, thereby making such cutting guide apparatus economically available to the buying public.

Still yet another object of the present invention is to provide a new and improved cutting guide apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
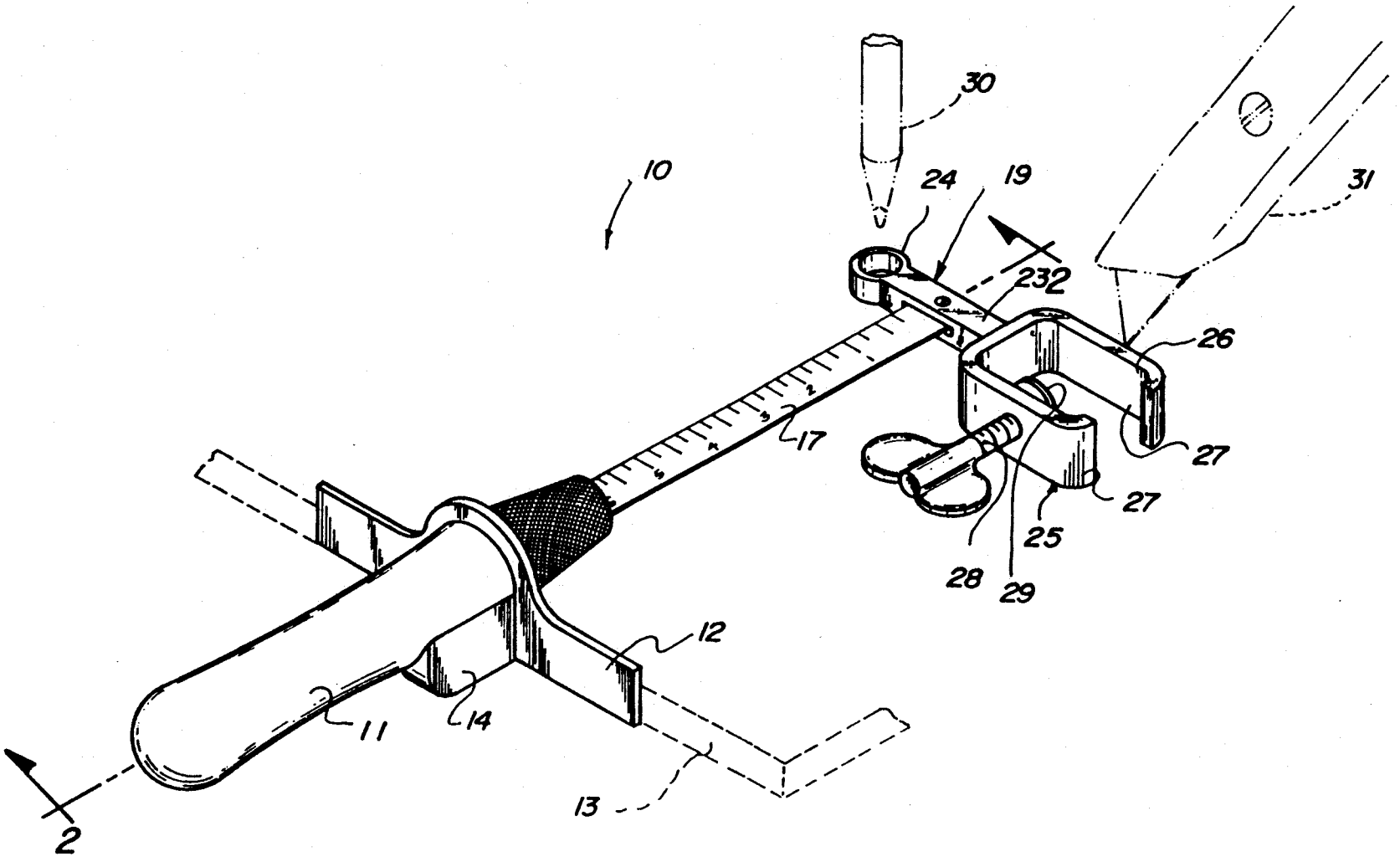
FIG. 1 is an isometric illustration of the instant invention.
Figure 2:
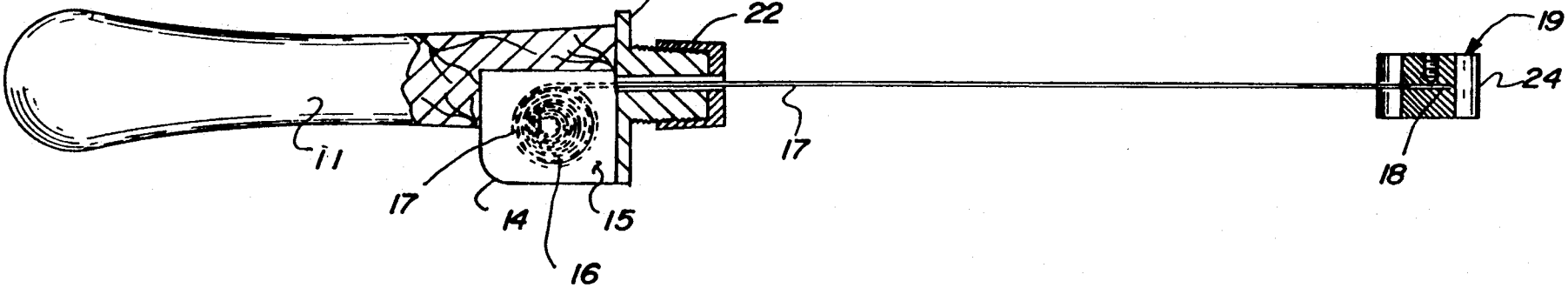
FIG. 2 is an orthographic view, taken along the lines 2—2 of FIG. 1 in the direction indicated by the arrows.
Figure 4:
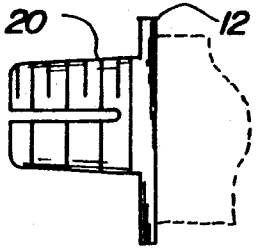
FIG. 4 is an orthographic side view of the split collet member utilized by the invention.
Figure 3:
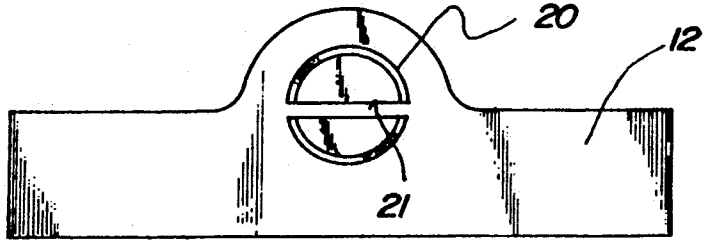
FIG. 3 is an orthographic elevational view of the collet structure arranged relative to the guide plate of the invention.
Figure 5:
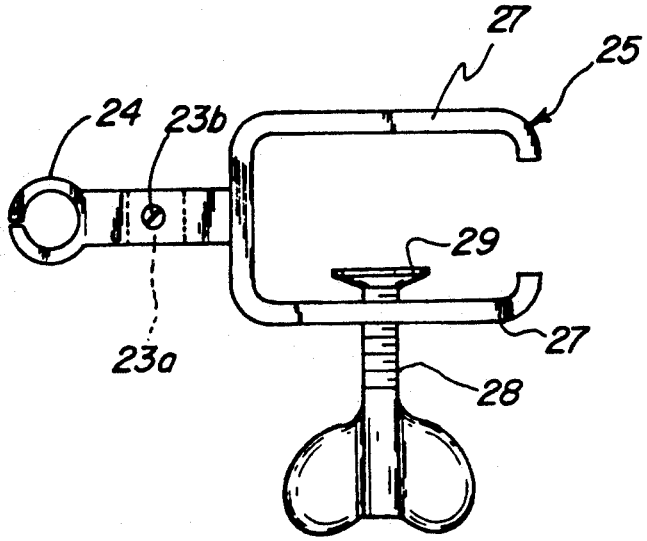
FIG. 5 is an orthographic top view of the central support plate and the alignment cylinder and clamp assembly used therewith.
Figure 6:
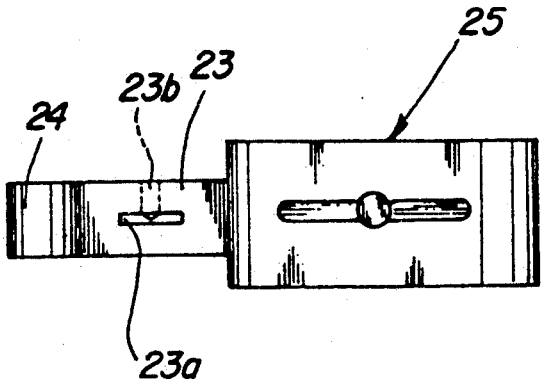
FIG. 6 is an orthographic view, taken in elevation, of the apparatus illustrated in FIG. 5.

With reference now to the drawings, and in particular to FIGS. 1 to 7 thereof, a new and improved cutting guide apparatus embodying the principles and concepts of the present invention and generally designated by the reference numerals 10 and 10*a* will be described.

More specifically, the cutting guide apparatus 10 of the instant invention essentially comprises a handle member 11 in a longitudinally aligned configuration, including a guide plate 12 fixedly and orthogonally mounted relative to the handle member at a forward distal end of the handle member. A workpiece side wall 13 is arranged for sliding engagement with a forward surface of the guide plate 12, as illustrated in FIG. 1. A storage magazine housing 14 is mounted to the handle member adjacent the guide plate 12 at a rear surface of the guide plate, with the storage magazine housing including a housing cavity 15, including a spindle 16 therewithin. A flexible measuring web 17 is wound about the spindle 16 and arranged for extension orthogonally through the guide plate 12 extending from the magazine housing 14. The measuring web 17 includes an outer distal end 18, including a support mount 19 mounted fixedly thereto. A conical split collet 20 extends from a forward face of the guide plate 12 receiving the measuring web 17 therethrough. The split collet 20 includes a slot 21 permitting the measuring web to be directed therethrough as the slot 21 is diametrically directed through the split collet 20. A conical collet cap 22 complementarily receives a split collet 20 therewithin, whereupon rotation of the conical collet cap 22 about the collet 20 effects a tightening of the split collet about the measuring web to effect locking of the measuring web relative to the collet 20.

A central support plate 23 is arranged to receive the measuring web outer distal end 18 within a support plate slot 23*a* projecting orthogonally into the support plate 23, with a slot fastener 23*b* orthogonally directed into the slot to secure the outer distal end 18 of the measuring web 17 relative to the support mount 19. An alignment cylinder 24 is mounted at a first end of the central support plate 23, wherein the alignment cylinder includes an alignment cylinder axis arranged parallel and spaced from the guide plate forward surface of the guide plate 12. A clamp assembly 25 is mounted to a second distal end of the central support plate 23 at an opposed side of the measuring web 17 that includes a "C" shaped yoke 26 formed with parallel clamp plates 27. A clamping rod 28 is orthogonally directed through one of the clamp plates 27 projecting within the "C" shaped yoke 26, with the clamping rod 28 externally threaded and threadedly received through the single clamp plate, with the clamping rod 28 including a flange 29 mounted to a forward distal end of the clamping rod 28 within the "C" shaped yoke 26 to engage a cutting tool 31. A writing instrument 30 alternatively is arranged for the reception within the alignment cylinder 24 to provide for selective marking and cutting for indicating purposes along the workpiece top surface, in a manner as indicated in FIG. 1.

Figure 7:
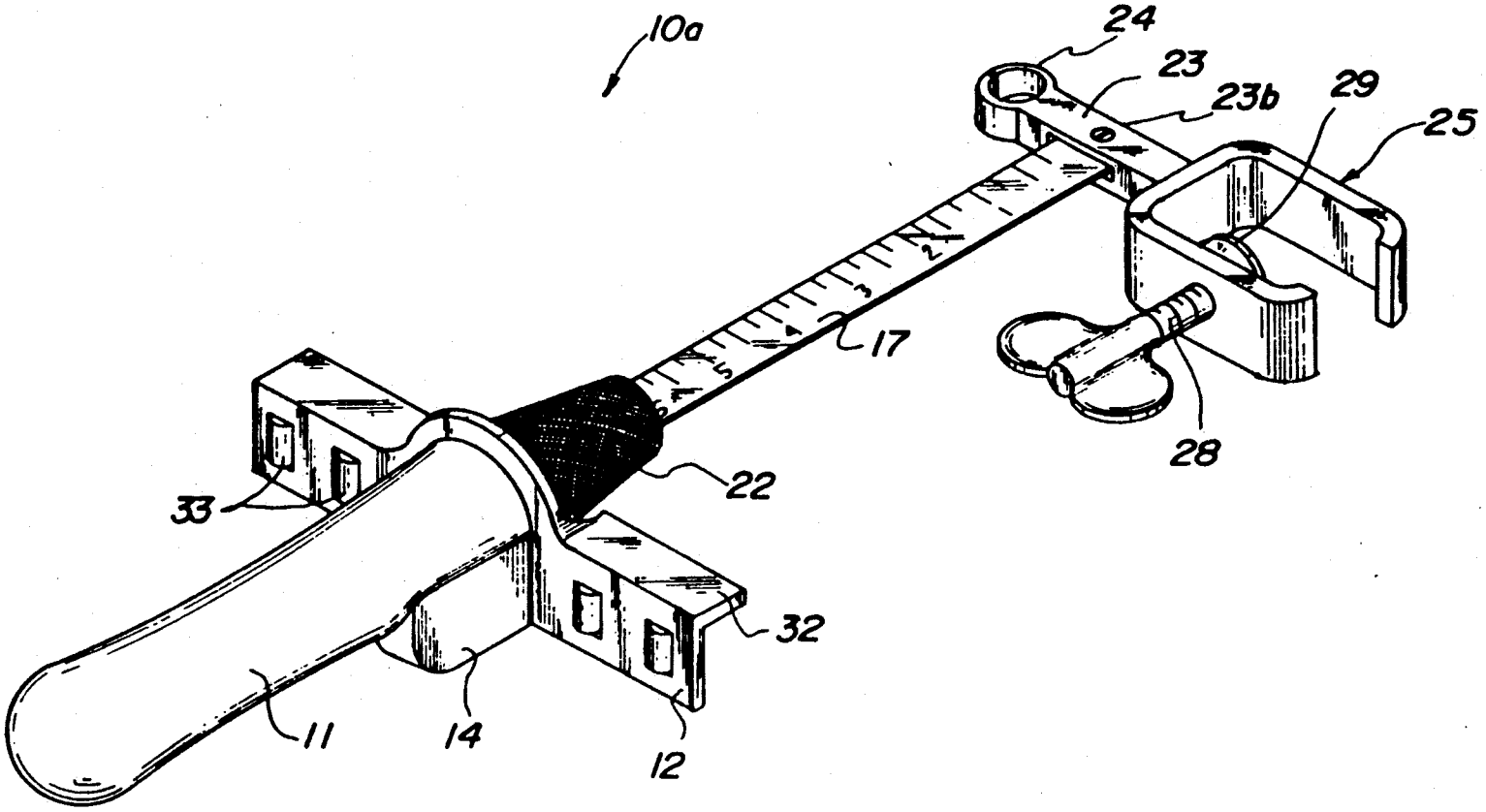
FIG. 7 is an isometric illustration of a modification of the invention. e

A modified apparatus 10*a* is illustrated in FIG. 7 wherein the guide plate 12 includes an abutment flange 32 orthogonally projecting forwardly of the forward surface of the guide plate 12, with the abutment flange 32 orthogonally and fixedly mounted to an upper terminal edge of the guide plate 12. In this manner, positioning of the guide plate relative to the top surface and to a side wall 13 of the workpiece is more readily effected. Further, a plurality of roller bearings 33 are rotatably mounted within the guide plate 12, with the roller bearings projected forwardly of the guide plate to provide ease of sliding relationship of the guide plate relative to a workpiece.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cutting guide apparatus, comprising, an elongate longitudinally aligned handle member, the handle member including a guide plate fixedly and orthogonally mounted to a forward distal end of the handle member spaced from a rear distal end of the handle member, and a flexible measuring web extending orthogonally and forwardly of the guide plate, and the flexible measuring web including a measuring web outer distal end, the measuring web outer distal end including a support mount secured thereto, wherein the support mounts includes a central support plate orthogonally and fixedly mounted to the measuring web outer distal end, and the support plate including a support plate first end and a support plate second end, wherein the first end and the second end are spaced on opposed sides of the flexible measuring web, and the first end including an alignment cylinder fixedly mounted to the support plate, wherein the alignment cylinder includes an alignment cylinder axis, wherein the axis is arranged parallel to the guide plate, and a clamp assembly mounted to the support plate second distal end, and the clamp assembly is arranged for securing a cutting instrument therewithin, and the clamp assembly includes a "C" shaped yoke, the "C" shaped yoke includes parallel plates, the parallel plates arranged parallel to the guide plate, and a clamping rod orthogonally and rotatably directed through one of the clamp plates, wherein the clamping rod includes a clamping rod flange orthogonally mounted to the clamp rod between the clamp plates, and the central support plate includes a support plate slot, the slot receives the measuring web outer distal end therewithin, and a fastener member arranged orthogonally through the support plate slot to secure the measuring web outer distal end therewithin.

2. An apparatus as set forth in claim 1 including a storage magazine housing fixedly mounted to the handle member adjacent the guide plate, the storage magazine housing including a magazine housing cavity, the magazine cavity including a spindle therewithin, and the flexible measuring web extending through the guide plate and received within the magazine housing cavity about the spindle, and the flexible measuring web is arranged for extension and retraction relative to the guide plate and received within the magazine housing cavity about the spindle.

3. An apparatus as set forth in claim 2 including a split collet member fixedly mounted to a forward face of the guide plate, with the split collet receiving in a sliding relationship the flexible measuring web therethrough, the split collet including a split collet slot diametrically directed through the split collet directing the measuring web through the split collet slot, and a conical cap threadedly receiving the split collet therewithin, wherein the split collet is of a conical configuration, whereupon tightening of the conical cap about the split collet effects selective securement of the flexible measuring web relative to the split collet.

4. An apparatus as set forth in claim 3 wherein the guide plate includes an abutment flange fixedly and orthogonally mounted to an upper distal end of the guide plate extending and projecting forwardly of the guide plate on opposed sides of the split collet.

5. An apparatus as set forth in claim 4 including a plurality of roller bearings rotatably mounted within the guide plate, wherein the roller bearings extend and project forwardly of the forward surface of the guide plate for rotative guidance along a workpiece side wall.

u

* * * * *